United States Patent [19]

Ochiai

[11] Patent Number: 4,864,836

[45] Date of Patent: Sep. 12, 1989

[54] ROLLING METHOD MAKING USE OF WORK ROLL SHIFT ROLLING MILL

[75] Inventor: Tsuneo Ochiai, Hitachi, Japan

[73] Assignee: Hitachi, Ltd., Tokyo, Japan

[21] Appl. No.: 143,199

[22] Filed: Jan. 13, 1988

[30] Foreign Application Priority Data

Jan. 24, 1987 [JP] Japan ..... 62-14461

[51] Int. Cl.[4] ..... B21B 1/24; B21B 31/18; B21B 31/20; B21B 37/00

[52] U.S. Cl. ..... 72/8; 72/11; 72/234; 72/243; 72/247

[58] Field of Search ..... 72/247, 234, 245, 243, 72/241, 21, 199, 366, 8, 9, 10, 11, 12

[56] References Cited

U.S. PATENT DOCUMENTS 4,658,620 4/1987 Masui et al. ..... 72/234
4,711,116 12/1987 Bald ..... 72/247 X
4,730,475 3/1988 Ginzburg ..... 72/247 X

FOREIGN PATENT DOCUMENTS 153849 9/1985 European Pat. Off. .
59-110401 6/1984 Japan .
0225803 12/1984 Japan ..... 72/247
61-92704 5/1986 Japan .
0126904 6/1986 Japan ..... 72/247
0154709 7/1986 Japan ..... 72/247
0193714 8/1986 Japan ..... 72/247

OTHER PUBLICATIONS

"Application of Work Roll Shift Mill 'HCW-mill' to Hot Strip and Plate Rolling", Hitachi Review, vol. 34, No. 4, Aug. 1985, pp. 153-160.

*Primary Examiner*—Lowell A. Larson
*Assistant Examiner*—Steven B. Katz
*Attorney, Agent, or Firm*—Fay, Sharpe, Beall, Fagan, Minnich & McKee

[57] ABSTRACT

A tandem rolling mill is operated such that roll stands of an upstream stage of the mill adjacent to a strip inlet thereof are positioned relative to each other to effect a strip crown control or an edge drop control, while roll stands of a downstream stage of the mill adjacent to a strip outlet thereof are operated to axially shift the downstream stage work rolls cyclically to distribute roll wear and thermal crown in the axial direction thereof.

9 Claims, 6 Drawing Sheets

ROLLING METHOD MAKING USE OF WORK ROLL SHIFT ROLLING MILL

BACKGROUND OF THE INVENTION

The present invention relates to a rolling method which makes use of a tandem rolling mill having a plurality of roll stands each including upper and lower work rolls movable relative to each other. The term "movable" in this specification is used to generally mean any possibility for the upper and lower work rolls to move relative to each other either axially thereof or angularly in horizontal planes.

DESCRIPTION OF THE PRIOR ART

U.S. Pat. No. 3,857,268 discloses in FIG. 2 a tandem roll mill in which upper and lower work rolls of each stand are shiftable in the axial direction of these rolls so as to vary the axial length over which each work roll and an associated backup roll contact with each other, thereby effecting crown control of a rolled strip. Japanese Patent Laid-Open Publication No. 55-77903 discloses a rolling mill in which one of upper and lower work rolls is tapered at its one axial end such that the diameter is progressively reduced towards the outer end extremity, while the other of the work rolls is similarly tapered at its end opposite to the tapered end of the first-mentioned work roll. In operation, the strip to be rolled and the work rolls are located relative to each other such that the both side edges of the strip are positioned in the vicinity of the tapered ends of the work rolls, thereby reducing the tendency of occurrence of edge drop. The rolling method which makes use of this type of rolling mill will be referred to as the one-sided taper roll position control method.

Japanese Patent Laid-Open Publication No. 55-64908 discloses a pair roll cross rolling mill in which each the of upper and lower work rolls together with its associated backup roll is angularly movable in a horizontal plane so that the angle formed between the axes of both work rolls is controllable. On the other hand, Japanese Patent Laid-Open Publication No. 56-30014 discloses a rolling mill in which the upper and lower work rolls of each stand are provided with point-symmetric profiles such as S-shaped or sine-curve-shaped profiles and are axially movable relative to each other. These two types of rolling mills have both been developed for the purpose of control of the strip crown.

A method termed "cycle-shift method" has been reported in HITACHI REVIEW, Vol. 34, No. 4, August 1985. In this method, work rolls are cyclically shifted in the axial direction so as to uniformly distribute any roll wear and thermal crown in the axial direction. This method, when applied to rolling of strips by any of the roll mills shown in FIG. 2 of the above-mentioned United States Patent and the three Japanese Publications, is not suited to axially uniformly distribute the roll wear and thermal crown, although the control of strip crown or edge drop can be achieved appreciably well.

FIGS. 8 and 9 of the above-mentioned United States Patent discloses a rolling mill of the type in which an intermediate roll is interposed between each work roll and an associated backup roll and is axially shiftable together with the associated work roll in accordance with the width of the strip to be rolled. When the above-mentioned cycle shift method is carried out with this type of rolling mill, both the wear of the work rolls and the thermal crown are uniformly distributed along the axes of the work rolls and the strip crown is also improved because the intermediate roll is shiftable. Unfortunately, however, the construction of this type of rolling mill is complicated due to the addition of the shiftable intermediate rolls and the installation and running costs are raised accordingly.

Accordingly, an object of the present invention is to provide a rolling method which makes use of a rolling mill having no intermediate roll between each work roll and the backup roll and which makes it possible to uniformly distribute the roll wear and the thermal crown, while improving the strip crown or edge drop.

SUMMARY OF THE INVENTION

In general, work rolls in roll stands on the material inlet end of a tandem rolling mill (such stands will be referred to as "upstream stands") are made of adamite or High-chromium. As a result of contacting with the material at a high temperature, the surfaces of these rolls are oxidized to form oxide films, so that the wear is very small on these rolls. On the other hands, rolls on roll stands near the outlet end of the mill (such stands will be referred to as "downstream stands") are usually made of nickel grain and exhibit heavy wear.

This fact will be more clearly seen in FIG. 10 which is a graph in which the axis of abscissa represents the No. of the roll stands, while the axis of ordinate represents the amount $\alpha$ of wear of work rolls in terms of roll diameter, copying coefficient $\beta$ which represents the coefficient of copy of the roll wear to the rolled product, and the amount or height of step ($\alpha \times \beta$) formed on the work roll and to be transferred to the strip. From this figure, it will be understood that the height of step ($\alpha \times \beta$) greatly increases from the inlet end towards the outlet end of the rolling mill.

In view of the above facts, according to the rolling method of the present invention which makes use of a tandem rolling mill, the strip crown or edge drop is controlled so as to improve the strip crown or to eliminate edge drop in upstream stand or stands which suffers from only slight wear of work rolls, whereas, in the downstream roll stand or stands which suffer from heavy wear of work rolls, the work rolls are reciprocally and, preferably, cyclically moved in the axial direction regardless of the width of the material, thereby axially distributing the wear of the work rolls as well as thermal crown.

The above and other objects, features and advantages of the present invention will become more clear from the following description of preferred embodiments with reference to the accompanying drawings.

DESCRIPTION OF THE PREFERRED EMBODIMENTS

Figure 1:
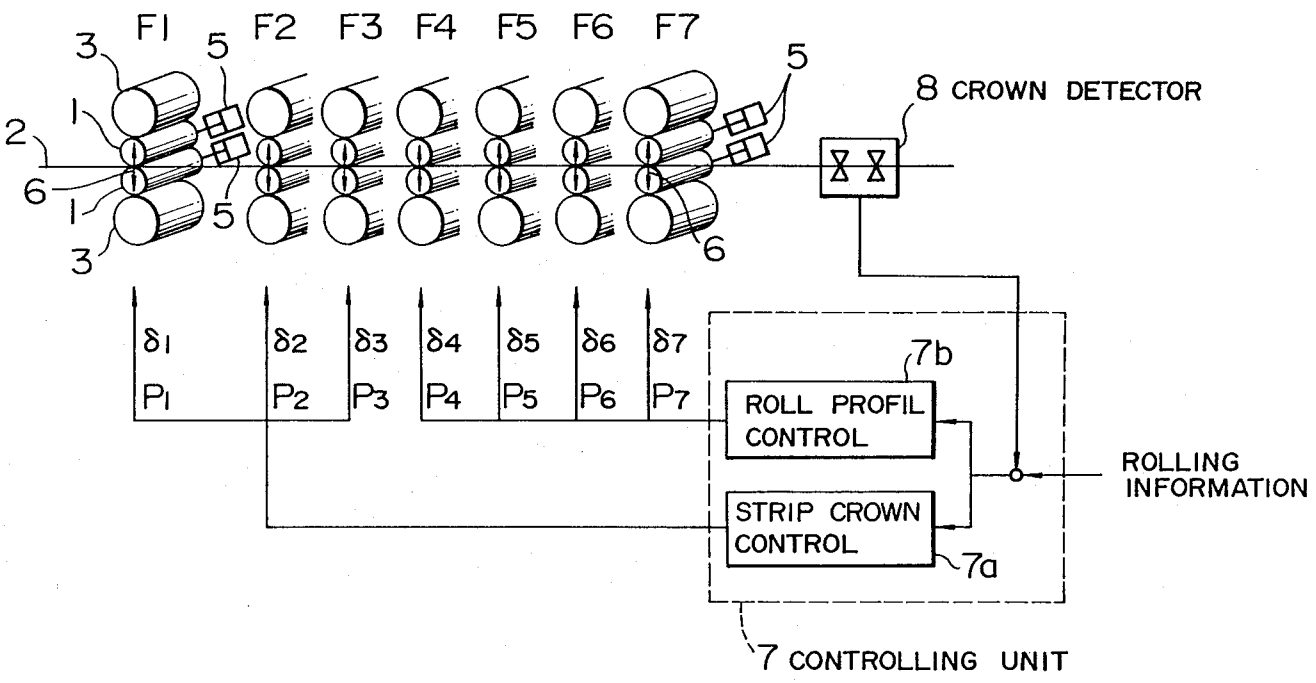
FIG. 1 is a schematic illustration of a tandem rolling mill and a controlling system suitable for use in carrying out the rolling method of the present invention.

Referring to FIG. 1, a tandem rolling mill has seven roll stands F1 to F7 each of which has upper and lower work rolls 1 and backup rolls 3 which back up the respective work rolls. In each of the roll stands F1 to F7, the upper and lower work rolls are axially shiftable in the opposite axial directions by means of work roll shifting means which is shown as being hydraulic cylinders 5 associated with the respective work rolls. The amount of shift of each work roll is indicated by $\delta$ with a suffix representing the No. of the roll stand. The series of roll stands F1 to F7 are so constructed that roll bender forces Pl to P7 are exerted onto the work rolls so as to urge the work rolls away from each other by benders 6 which are indicated by double-headed arrows. The work roll shifting means 5 for axially displacing the work rolls and the roll bender 6 have been known and disclosed, for example, in the aforementioned United States Patent, so that detailed description thereof is omitted in this specification. Although work roll shifting means 5 associated with the first and the seventh roll stands F1 and F7 are shown, it will be obvious to those skilled in the art that similar work roll shifting means are provided also for other rolls stands F2 to F6.

The rolling mill is equipped with a control unit 7 which is capable of controlling the amounts $\delta$ of shift of the work rolls 1 as well as the roll bender forces P by the control of the work roll shifting means 5 and the roll benders 6 of all the roll stands F1 to F7 in accordance with rolling information concerning the rolling conditions such as the kind of the material 2 to be rolled, temperature of the material, thicknesses and width of the materials before and after the rolling and the rolling speed. The crown of the strip of the material 2 delivered from the final roll stand F7 is detected by a crown detector 8 and the result is fed back to the control unit 7, whereby a desired crown is attained on the strip material 2 rolled by the method of the present invention. Such a feedback control system is well known to those skilled in the art, so that no further explanation will be needed.

The series of roll stands of the tandem rolling mill is divided into two stages or groups: namely, an upstream stage adjacent to the inlet for the material 2 and constituted by three upstream roll stands F1 to F3 and a downstream stage adjacent to the outlet for the material 2 and constituted by four downstream roll stands F4 to F7.

First Embodiment

Figure 2:
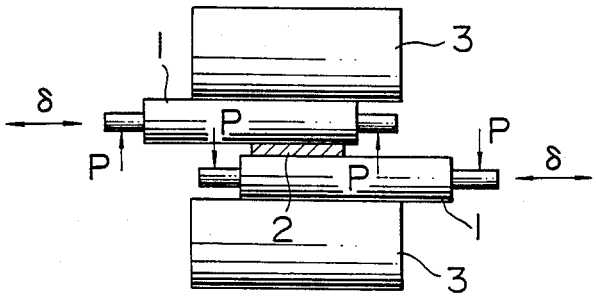
FIG. 2 is a schematic front elevational view of an example of an arrangement of work rolls and backup rolls in one of a plurality of upstream roll stands of the tandem rolling mill shown in FIG. 1.
Figure 6:
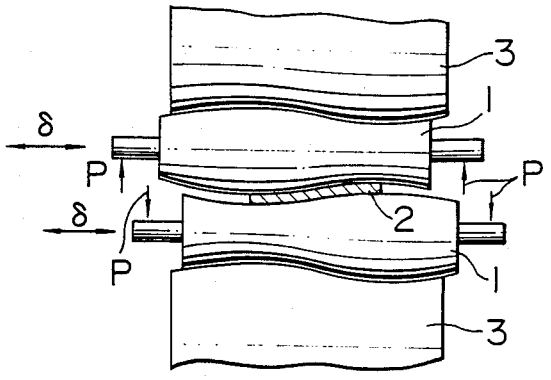
FIG. 6 is a schematic front elevational view of another example of the work rolls and backup rolls in an upstream roll stand of the tandem rolling mill shown in FIG. 1.

In the first embodiment of the rolling method of the present invention, the roll stands F1 to F3 of the upstream stage conduct the rolling in accordance with the crown control mode, whereas the roll stands F4 to F7 of the downstream stage conduct the rolling in accordance with the roll profile control method. More specifically, in each of the roll stands F1 to F3 of the upstream stage, the upper and lower work rolls 1 are axially shifted in opposite directions in an amount according to the width of the material 2 to positions optimum for the crown control rolling, as shown in FIG. 6. Alternatively, one end of the upper roll is positioned in the vicinity of the corresponding edge of the material 2 while the end of the lower work roll opposite to the above-mentioned end is located in the vicinity of the other edge of the rolled material, as shown in FIG. 2. This control is effected by a crown control means 7*a* in the control unit 7 which sets the amount $\delta_1$ to $\delta_3$ of axial roll shifts in the respective roll stands F1 to F3 to be optimum for the control of the crown. A similar control can be effected for the cross mill shown in FIG. 7 in which the upper and lower work rolls in each roll stand are angularly movable in horizontal planes. Simultaneously, the roll bender forces P1 to P3 applied by the roll benders 6 to the work rolls 1 in the respective roll stands F1 to F3 are controlled by the crown control means 7*a* such that bender forces optimum for the crown control are obtained in the respective roll stands.

Figure 2A:
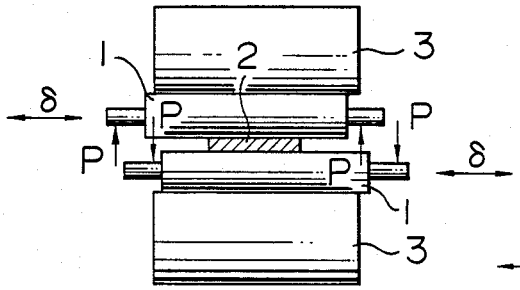
FIGS. 2A and 2B are similar to FIG. 2 but show work rolls and backup rolls in a downstream roll stand of the rolling mill shown in FIG. 1.
Figure 2B:
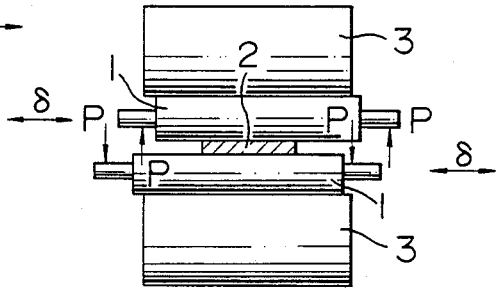

In the roll stands F4 to F7 in the downstream stage of the tandem rolling mill, the work rolls 1 are reciprocally and cyclically moved in the axial direction, as shown in FIG. 2A. This reciprocal shift is conducted at predetermined intervals regardless of the widths of the strips 2. At the same time, the roll bender forces P4 to P7 are set at levels which are optimum for the roll profile control. The control of the work roll shifting means 5 and the setting of the roll bender forces P4 to P7 in the respective stages F4–F7 are performed by a roll profile control means 7*b* in the control unit 7.

As will be understood from the foregoing description, in the first embodiment of the present invention, the profile, i.e., cross-sectional shape, of the rolled strip 2 is controlled and regulated by virtue of the crown control mode of rolling operation performed by the roll stands F1 to F3 of the upstream stage, whereas, in the roll stands F4 to F7 of the downstream stage, the roll wear and thermal crown are substantially uniformly distributed along the length of each work roll so as to eliminate any local concentration of wear because these roll stands F4 to F7 are operated in the cycle shift mode.

Experimental Test 1

Figure 4:
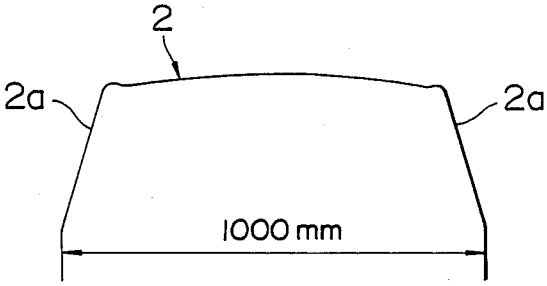
FIG. 4 is a somewhat exaggerated illustration of the profile of a strip rolled in accordance with a first embodiment of the method of the present invention.

A test operation was conducted using the 7-stand work roll shift type tandem rolling mill as shown in FIGS. 1 to 2A. In this test, 140 pieces of strips of 1000 mm width were continuously rolled by making use of this roll mill. Throughout the test, the work rolls 1 of the roll stands F1 to F3 of the upstream stage were positioned as shown in FIG. 2 with respect to the material 2, while the work rolls of the roll stands F4 to F7 of the downstream stage were cyclically shifted for each coil in accordance with the shift pattern which is shown in "Shift Pattern" of the "Case B" in FIG. 3. The profile of the strip material produced by this test rolling is shown in FIG. 4 in a somewhat exaggerated manner. The state of wear caused on the work rolls 1 throughout the rolling process is shown in "Work Roll Wear Profile" of the "Case B" in FIG. 3.

A comparison test was conducted for the purpose of evaluating the test result shown in FIG. 4. In this comparison test, 140 pieces of strips 2 of material and width the same as those of the strips produced in the above-mentioned test operation were rolled by making use of a rolling mill of the same construction as that of the rolling mill shown in FIGS. 1 and 2, with the work rolls 1 of the all stands F1 to F7 fixedly set at the optimum crown control positions shown in FIG. 2. In this case, the shift pattern of the work rolls 1 is as shown in "Shift Pattern" of the "Case A" in FIG. 3 because none of the work rolls 1 is shifted during the rolling operation. The state of wear caused on the work rolls 1 is shown in "Work Roll Wear Profile" of the "Case A" in FIG. 3. The profile of the rolled strip is shown in FIG. 5 in a somewhat exaggerated manner.

Figure 3:
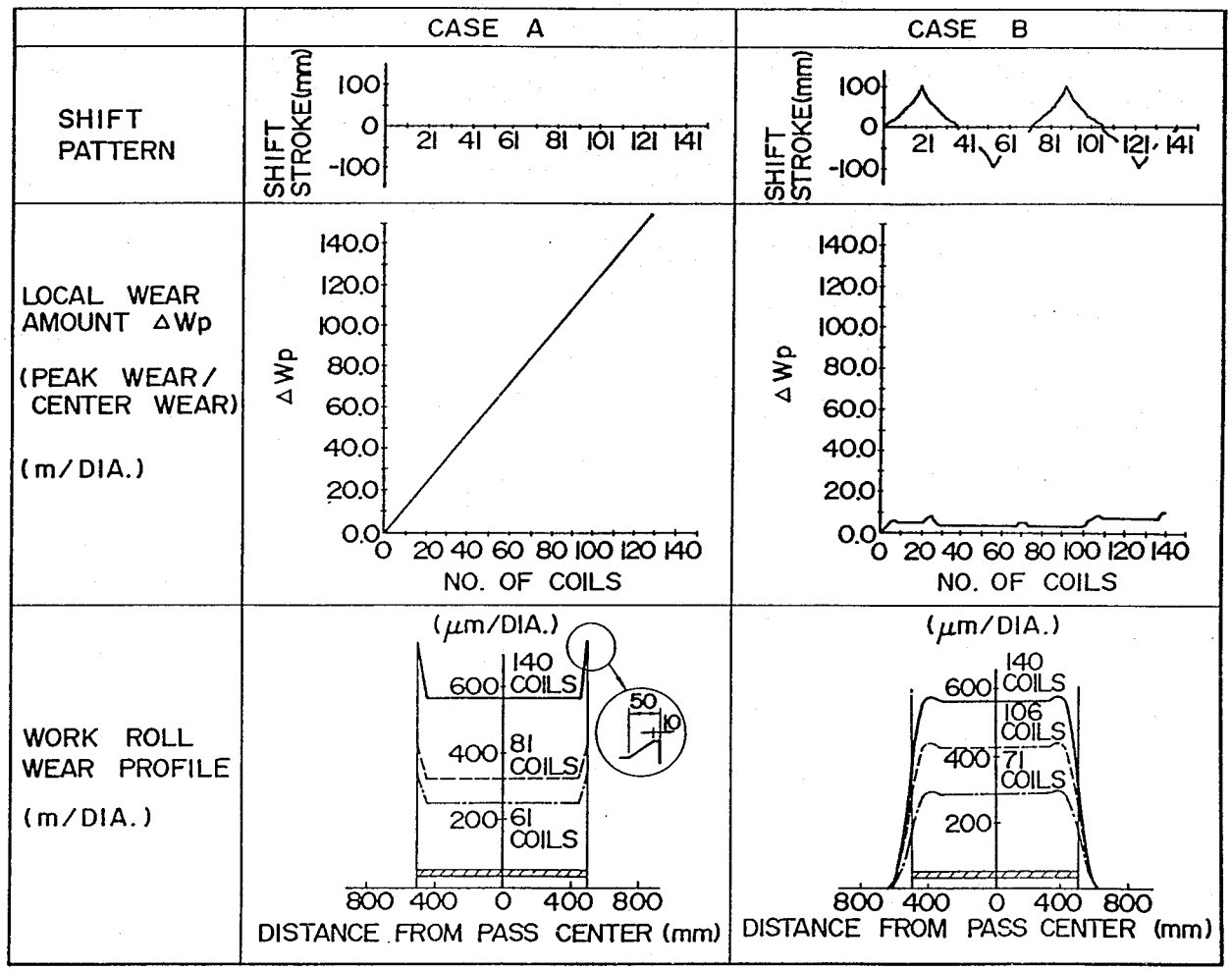
FIG. 3 is a diagram illustrating work roll local wear and work roll wear profile in relation to Case A (work rolls are not shifted pattern both in crown control and Case B (roll profile is controlled)
Figure 5:
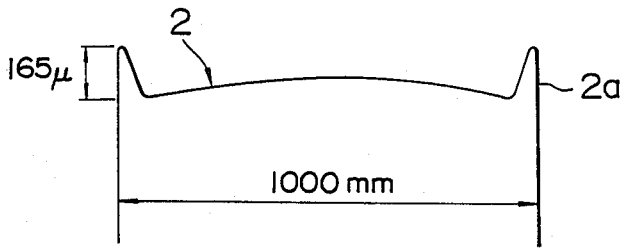
FIG. 5 PRIOR ART
FIG. 5 is a somewhat exaggerated illustration of the profile of a strip rolled without cycle shift method.

A comparison between the work roll wear profiles in "Case A" and "Case B" in FIG. 3 as well as between the strip profiles shown in FIGS. 4 and 5 clearly shows that, in the "Case A" in which the rolling was conducted with the work rolls 1 of all the stands F1 to F7 fixed at predetermined positions, each work roll was heavily worn over an axial region corresponding to the width of the strip 2 and that this heavy wear of the roll was copied to the rolled strip 2 so that keen projection of a height of about 165 microns was formed on each lateral or side edge of the strip 2. In contrast, in "Case B", the influence caused on the rolled strip 2 by the wear of the work rolls 1 in the roll stands F1 to F3 of the upstream stage was effectively cancelled by virtue of the cyclical shift of the work rolls 1 in the roll stands F4 to F7 of the downstream stage, so that the projection formed on each lateral or side edge of the strip 2 was as low as 10 microns or less which is practically negligible. In this case, however, a local thinning known as "edge drop" was caused on each lateral edge 2*a* of the strip.

Experimental Test 2

Another test operation was conducted by executing the operation modes of "Case A" and "Case B" by making use of a work roll shift mill in which the work rolls 1 and the backup rolls 3 of the roll stands F1 to F3 of the upstream stage were of the structure shown in FIG. 6 while the work rolls 1 and the backup rolls 3 of the downstream stage roll stands F4 to F7 were of the structure shown in FIG. 2A. The upper and lower work rolls 1 shown in FIG. 6 were of the type disclosed in the aforementioned Japanese Patent Laid-Open Publication No. 56-30,014. Namely, the upper and lower work rolls 1 had profiles defined by curves symmetrical with each other with respect to a point. The result obtained by the operation in "Case A" mode was similar to that obtained in "Case A" in the Experimental Test 1; namely, the strip 2 showed a profile as shown in FIG. 5. Similarly, the result obtained by the operation in "Case B" mode was substantially the same as that obtained in "Case B" in the Experimental Test 1; namely, the strip 2 showed a profile as shown in FIG. 4.

Experimental Test 3

Figure 7:
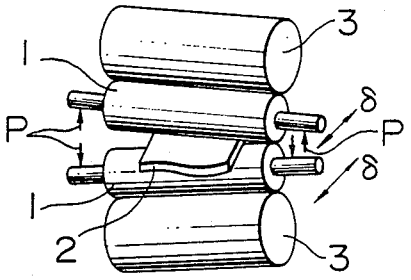
FIG. 7 is a schematic perspective view of a still another example of the work rolls and backup rolls in an upstream roll stand of the tandem rolling mill shown in FIG. 1.

A further test operation was conducted both in the "Case A" mode and "Case B" mode as in Experimental Test 1 by employing a rolling mill in which the upstream roll stands F1 to F3 were of a pair roll cross rolling type shown in FIG. 7. This type of rolling mill is disclosed in the aforementioned Japanese Patent Laid-Open Publication No. 55-77903. The downstream roll stands F4 to F7 were of the structure shown in FIG. 2A. In the test operation in the "Case A" mode, the work rolls 1 in all of the rolls stands where fixedly held at positions optimum for the crown control throughout the test, whereas, in the "Case B" mode, the work rolls of the roll stands F4 to F7 in the downstream stage were cyclically shifted for a predetermined number of coils. The results obtained from the test operation in the "Case A" mode and in the "Case B" mode were substantially the same as those obtained in "Case A" and "Case B" in the Experimental Test 1 described before.

Second Embodiment

Figure 8:
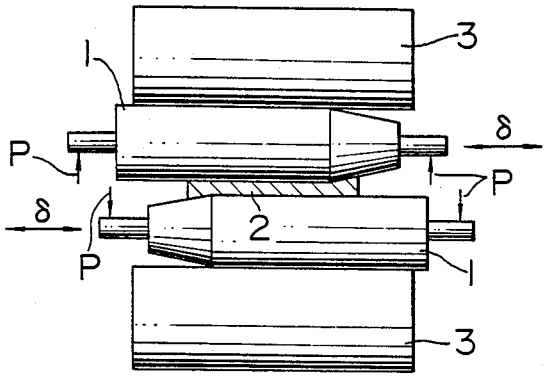
FIG. 8 is a schematic front elevational view of work rolls and backup rolls in an upstream roll stand of the tandem rolling mill shown in FIG. 1 used in carrying out a second embodiment of the method in accordance with the present invention.

In the second embodiment of the present invention, the rolling by the roll stands F1 to F3 of the upstream stage of the rolling mill is conducted in accordance with the one-sided taper roll position control method, whereas, the roll stands F4 to F7 of the downstream stage are controlled in accordance with the roll profile control method. More specifically, the second embodiment of the rolling method in accordance with the invention employs roll stands of the type shown in FIG. 8. Throughout the rolling operation, the work rolls 1 of the roll stands F1 to F3 are fixedly held at positions optimum for the edge drop control as shown in FIG. 8, while the work rolls in the roll stands F4 to F7 are cyclically shifted. In this embodiment, the strip 2 rolled through the roll stands F1 to F3 of the upstream stage exhibits such a thickness distribution that the thickness is greater at both side edge portions than at the mid portion of the strip. The strip having such a thickness distribution is then rolled through the roll stands F4 to F7 of the downstream stage, so that the final rolled strip exhibits a smaller edge drop at the edge portions 2*a* than in the case of the strip in accordance with the first embodiment of the method of the invention.

Experimental Test 4

Figure 9:
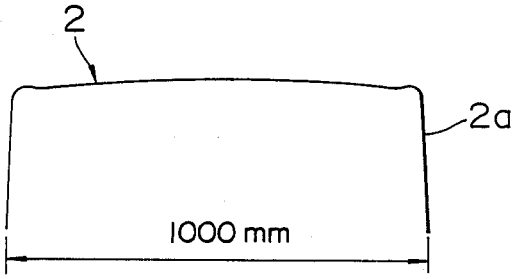
FIG. 9 is a somewhat exaggerated illustration of a strip profile of a strip rolled in accordance with the second embodiment of the method of the present invention.
Figure 10:
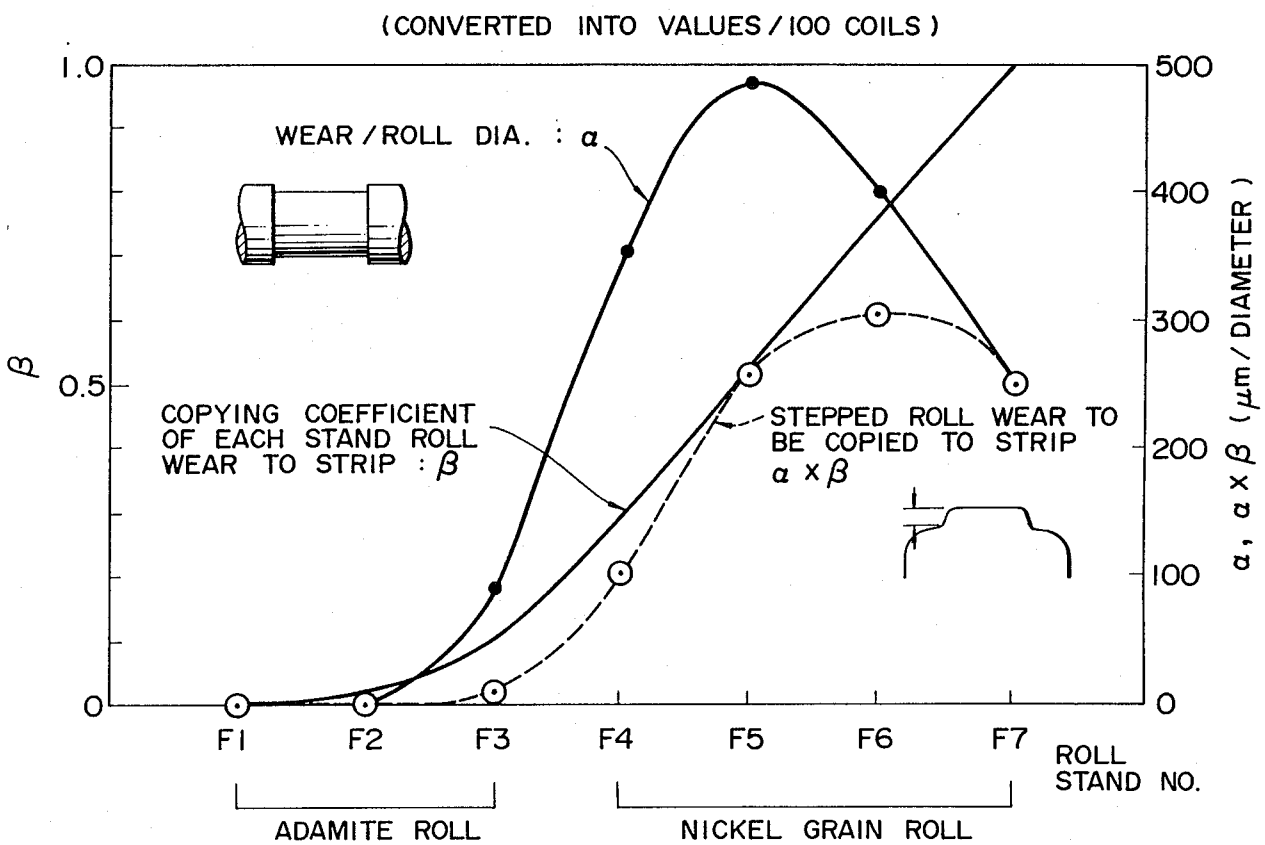
FIG. 10 is a graph showing the relationship between roll wear in terms of roll diameter, coefficient of copy of roll wear to strip and stepped roll wear to be copied to the strip in each of roll stands.

A still further test rolling was conducted with a work roll shift mill having an upstream stage composed of three roll stands F1 to F3 of the type shown in FIG. 8 and a downstream stage composed of four roll stands F3 to F7 of the type shown in FIG. 2A. The roll stand shown in FIG. 8 is the same one as one disclosed in Japanese Patent Laid-Open Publication No. 55-77903 referred to above. In this roll stand, the upper work roll 1 is tapered at its one axial end (right end as viewed in FIG. 8) such that the diameter is progressively decreased towards the outer end extremity, while the lower work roll 1 is similarly tapered at its end which is on the left side as viewed in FIG. 8. The strip 2 was located with respect to these work rolls such that both edges of the strip 2 were registered with the adjacent tapered portions of the upper and lower work rolls 1. The roll stands F4 to F7 of the downstream stage of the mill were the same as those shown in FIG. 1. The work rolls of these stands were cyclically shifted in accordance with the shift pattern of the "Case B" in the Experimental Test 1. Rolling test was conducted in the same way as in the preceding test operations. The result is shown in FIG. 9. As will be understood from the strip profile shown in FIG. 9, the rolling in accordance with the second embodiment of the present invention causes an edge drop which is much smaller than that caused by the first embodiment of the method of the present invention.

As will be understood from the foregoing description, the rolling method of the invention remarkably improves the strip crown or the edge drop as compared with those caused in the prior art rolling methods and provides substantially uniform distributions of roll wear and thermal crown in the axial direction of the work rolls. This enables the work rolls of the downstream stage to withstand a greatly increased number of rolling operations.

What is claimed is:

1. A rolling method by use of a tandem rolling mill having at least two roll stands one of which forms an upstream stage of the mill adjacent to a strip inlet thereof and the other roll stand forms a downstream stage of the mill adjacent to a strip outlet thereof, each of said roll stands including upper and lower work rolls movable relative to each other, said rolling method comprising:

operating the roll stand of said upstream stage in such a manner as to control one of the crown and edge drop of each strip to be rolled; and operating the roll stand of said downstream stage in such a manner as to reciprocally shift said downstream stage work rolls axially thereof regardless of the width of each strip to be rolled.

2. A rolling method according to claim 1, wherein the reciprocal shifting of said downstream stage work rolls is conducted cyclically for each of a predetermined number of passes of strips.

3. A rolling method according to claim 2, wherein the reciprocal shifting of said downstream stage work rolls is effected in such a manner as to attain a substantially uniform distribution of roll wear and thermal crown in the axial directions of said work rolls.

4. A rolling method according to claim 1, wherein the roll stand of said upstream stage is operated to control the crowns of strips to be rolled.

5. A rolling method according to claim 1, wherein the roll stand of said upstream stage is operated to control the edge drops of strips to be rolled.

6. A rolling method by use of a tandem rolling mill having at least two roll stands one of which forms an upstream stage of the mill adjacent to a strip inlet of the mill and the other roll stand forms a downstream stage of the mill adjacent to a strip outlet of the mill, each of said roll stands having upper and lower work rolls axially shiftable relative to each other, said rolling method comprising:

operating the roll stand of said upstream stage such that the relative axial positions of said upstream stage work rolls are fixedly set in accordance with rolling conditions including widths of strips to be rolled, rolling load, rolling speed, material of the strips and rolling temperature; and operating the roll stand of said downstream stage such that the downstream stage work rolls are axially reciprocally shifted in accordance with a predetermined pattern.

7. A rolling method according to claim 6, wherein the stroke of the reciprocal shifting movement of each of the downstream stage work rolls is set regardless of the widths of strips to be rolled.

8. A rolling method according to claim 7, wherein said reciprocal shifting is conducted cyclically for each of a predetermined number of passes of strips.

9. A rolling method for a tandem rolling mill having at least one upstream stage roll stand adjacent a strip inlet and at least one downstream stage roll stand adjacent a strip outlet, wherein each of the roll stands has upper and lower work rolls movable relative to each other, comprising the steps of:

controlling the rolling of a strip to be rolled with said upstream stage roll stand of the mill in order to optimize one of the crown and edge drop of each strip while controlling the axial distribution of wear and thermal crown of the work rolls of the downstream stage roll stand of the mill by controlling the upstream stage roll stands in accordance with a detected crown of a strip that has passed through the mill by a crown detector at the strip outlet thereof including axially shifting the upper and lower work rolls of the roll stands of the upstream stage in opposite directions in accordance with a width of the strip or by applying roll bending forces to the work rolls of the upstream stage roll stands to obtain the optimum one of the crown and edge drop control; and cyclically shifting the work rolls of the downstream stage roll stands in accordance with an experimentally determined shift pattern that uniformly distributes in the axial direction the roll wear and thermal crown of the work rolls of the downstream stage roll stand independently of a width of a strip being rolled.

* * * * *